US009011201B2

(12) United States Patent
Chen

(10) Patent No.: US 9,011,201 B2
(45) Date of Patent: Apr. 21, 2015

(54) BRA ASSEMBLY WITH ATTACHED COVERING

(71) Applicant: Bragel International, Inc., Pomona, CA (US)

(72) Inventor: David E. Chen, Walnut, CA (US)

(73) Assignee: Bragel International, Inc., Pomona, CA (US)

( * ) Notice: Subject to any disclaimer, the term of this patent is extended or adjusted under 35 U.S.C. 154(b) by 0 days.

(21) Appl. No.: 13/829,841

(22) Filed: Mar. 14, 2013

(65) Prior Publication Data

US 2014/0213146 A1 Jul. 31, 2014

Related U.S. Application Data

(60) Provisional application No. 61/758,082, filed on Jan. 29, 2013.

(51) Int. Cl.
*A41C 3/06* (2006.01)

(52) U.S. Cl.
CPC ..... *A41C 3/065* (2013.01)

(58) Field of Classification Search
CPC ..... A41C 3/00; A41C 3/0014; A41C 3/0078; A41C 3/02; A41C 3/06; A41C 3/065; A41C 3/10; A41C 3/14; A41C 3/142; A41C 3/144; A41C 3/146; A41C 3/148
USPC ..... 450/7–11, 23–28, 30–35, 92, 93, 1, 81, 450/86, 54–57, 58; 2/105, 106, 109–110, 2/113–115, 73, 78.1–78.4, 46, 69
See application file for complete search history.

(56) References Cited

U.S. PATENT DOCUMENTS

| | | | | |
|---|---|---|---|---|
| 2,863,460 | A * | 12/1958 | Monroe | 450/11 |
| 2,869,552 | A * | 1/1959 | Smith | 450/32 |
| 5,693,164 | A | 12/1997 | Chang | |
| 6,758,720 | B2 * | 7/2004 | Chen | 450/57 |
| 6,780,081 | B2 | 8/2004 | Chen et al. | |
| 6,852,001 | B2 | 2/2005 | Chen et al. | |
| 6,857,932 | B2 | 2/2005 | Chen | |
| 6,935,921 | B1 * | 8/2005 | Eudenbach et al. | 450/54 |
| 7,407,429 | B2 | 8/2008 | Chen | |
| 7,409,728 | B2 * | 8/2008 | Harry | 2/106 |
| 7,585,200 | B1 * | 9/2009 | McLaren | 450/89 |
| 7,704,120 | B2 | 4/2010 | Chen et al. | |
| 8,182,310 | B2 * | 5/2012 | Clair et al. | 450/30 |
| 8,221,189 | B2 | 7/2012 | Chen et al. | |
| 2009/0270013 | A1 * | 10/2009 | Clair et al. | 450/30 |
| 2012/0208434 | A1 | 8/2012 | Chang | |

* cited by examiner

*Primary Examiner* — Gloria Hale
(74) *Attorney, Agent, or Firm* — Christie, Parker & Hale, LLP

(57) ABSTRACT

An adjustable backless and strapless bra having a covering over the front. The backless and strapless bra assembly includes a pair of bra cups, each bra cup including an outer edge, a connector between the bra cups, and a covering coupled to the outer edge of each bra cup and extending from one of the pair of bra cups to the other one of the pair of bra cups across an outside surface of the bra cups.

18 Claims, 7 Drawing Sheets

BRA ASSEMBLY WITH ATTACHED COVERING

CROSS-REFERENCE TO RELATED APPLICATION(S)

This application claims priority to U.S. Provisional Application No. 61/758,082, filed Jan. 29, 2013, the contents of which are incorporated herein by reference.

FIELD OF THE INVENTION

The present invention relates to a bra assembly, and more particularly, to an adjustable backless, strapless bra having a covering over the front.

BACKGROUND OF THE INVENTION

Various devices and methods are available to women who wish to enhance their breasts. Generally, women can either undergo a surgical procedure to be fitted with a breast implant, or can use some form of externally worn article. To accommodate women wishing to avoid the dangers involved with surgical breast implants, several efforts have been made to provide externally worn articles that have the look and feel of natural breasts, yet are non-permanent and health-risk free. Such externally worn devices have included a wide range of foam pads, push-up bras, and more recently gelled breast inserts to be worn between the user's breasts and a bra.

In addition to the demand for devices and methods for enhancing breast size and shape, there is also a demand for being able to use those devices and methods while wearing a full-range of clothing. For example, women wearing a backless dress or a halter top will not want to wear a traditional bra. As a result, bras have been developed that are both backless and strapless. Such backless, strapless bras have used non-permanent adhesives, such as a disposable double-sided tape, to secure the bra to the user.

There has further been a demand for lightweight and convenient devices and methods for covering up the bra. For example, if a day is particularly hot, women would prefer not to wear an extra tank top or t-shirt under a low-cut dress or a sheer garment. However, these women would still prefer to cover their bra so as not to be visible to others. Moreover, women that wear low-cut dresses may want to cover part of their cleavage, but without having to wear another article of clothing.

As a result, there exists a need for a bra assembly that includes a backless, strapless bra for pushing-up the breasts and enhancing breast cleavage where the bra includes a reusable adhesive that allows the user to position the bra in a desired position without concern of the bra shifting from that position and where the bra assembly has a covering over the front in order to conceal the bra.

SUMMARY OF THE INVENTION

Embodiments of the present invention provide an adjustable backless, strapless bra having a covering over the front.

According to an aspect of the present invention, there is provided a backless and strapless bra assembly including a pair of bra cups, each bra cup including an outer edge, a connector between the bra cups, and a covering coupled to the outer edge of each bra cup and extending from one of the pair of bra cups to the other one of the pair of bra cups across an outside surface of the bra cups.

The covering may include excess fabric so as to be loose in a center portion of the bra assembly.

The covering may be made from stretchable fabric.

The covering may be coupled to the outer edge of each bra cup by being sewn along the outer edge of each bra cup.

The pair of bra cups may further include a pair of interior surfaces wherein a pressure sensitive adhesive layer is on the pair of interior surfaces.

The pressure sensitive adhesive layer may include about 30% to about 100% of the pair of interior surfaces.

The pressure sensitive adhesive layer may be applied to the pair of interior surfaces by spray coating, hot melting, extrusion application, or die application.

The pressure sensitive adhesive layer may further include silicone gel adhesive.

The pressure sensitive adhesive layer may further include double-sided tape.

The pressure sensitive adhesive layer may further include an adhesion force to the pair of bra cups that is greater than an adhesion force to a user's skin.

The connector may further include a first portion attached to one of the pair of bra cups and a second portion attached to the other one of the pair of bra cups.

The connector may be part of the covering.

The covering may be a lace covering.

DETAILED DESCRIPTION

Figure 1:
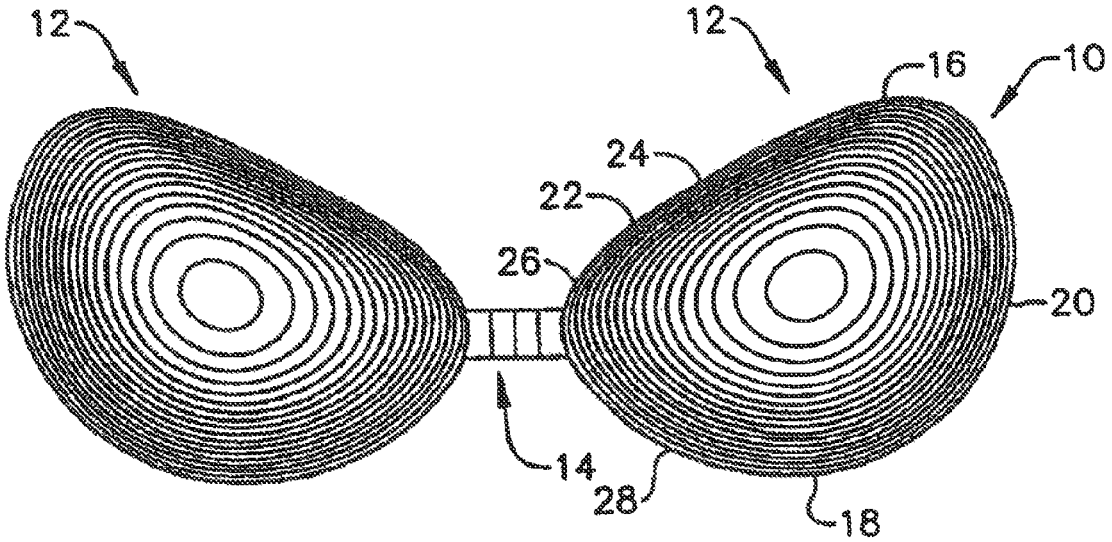
FIG. 1 is a front view of a backless, strapless bra having a pair of bra cups adjoined by a connector according to an exemplary embodiment of the present invention.

A bra assembly constructed according to principles of this invention generally comprises a pair of bra cups adapted to be joined together and a covering on top of both bra cups so as to conceal the exterior portion of the bra cups.

The covering can be made of any suitable type of material or fabric. In an exemplary embodiment, the covering is made from a two-way or four-way stretchable fabric such as LYCRA® or SPANDEX in order to allow the garment to conform to the shape of the user's breasts after the bra cups have been positioned over the user's breasts, particularly in a lateral direction across the user's chest.

Furthermore, using at least a two-way stretchable fabric or material that stretches in a lateral direction across the user's chest allows the position of the bra cups to be changed relative the user's breasts without causing the covering to be bunched together or overly extended near the center of the user's chest.

The covering is integral with, or built-into, the bra assembly, meaning that the covering is a part of the bra assembly.

The attachment between the covering and bra assembly, however, can be achieved numerous ways and at different stages in the manufacturing process. For example, the covering may be sewn into the bra cups along their edges and stretched across the front of the bra.

Thus, the covering and bra assembly may be presented to the end consumer as a single, integral garment, but can be assembled separately and then combined later. The covering comprises an inside surface that faces towards the user's skin and an outside surface facing opposite the inside surface. The bra cups are adjoined to the inside surface of the covering, such that the bra cups can be worn over the user's breasts underneath the covering.

An exemplary bra assembly generally comprises a backless, strapless bra. The bra includes a pair of bra cups adapted to be joined together by a center connector that is positioned between opposing inner surfaces of the two bra cups. The connector is shown as having separate components that attach to each of the bra cups, but any configuration or structure having means to draw the two bra cups together can be a suitable connector, including the covering itself achieving that function. The bra cups each have a pressure sensitive adhesive layer on their interior surfaces that enables the bra cups to be removably attached to each of a user's left and right breasts. The bra cups are separate articles that are independently placed on a left and right breast of a user. Each of the bra cups has the same structure, except one is designed to support and enhance the left breast and the other is designed to support and enhance the right breast. Furthermore, the bra cups can be either permanently or removably adjoined by the connector.

Generally, the user of the bra positions the pressure sensitive adhesive layer of each of the bra cups on the left and right breasts, and then adjoins the bra cups to each other by engaging the connector. The user can create varying degrees of breast cleavage and breast push-up enhancement depending on where the bra cups are positioned on the user's breasts and how much the connector pulls the two bra cups towards each other. Furthermore, the placement of the connector relative to the top and bottom of the bra cups will impact the degree of cleavage and push-up enhancement. Accordingly, the bra enables the user to position the bra cups at a desired position and control the amount of cleavage and push-up enhancement by adjoining the bra cups with the connector. It is also possible, however, for the bra cups to be permanently adjoined together by a fixed connector.

Figure 2:
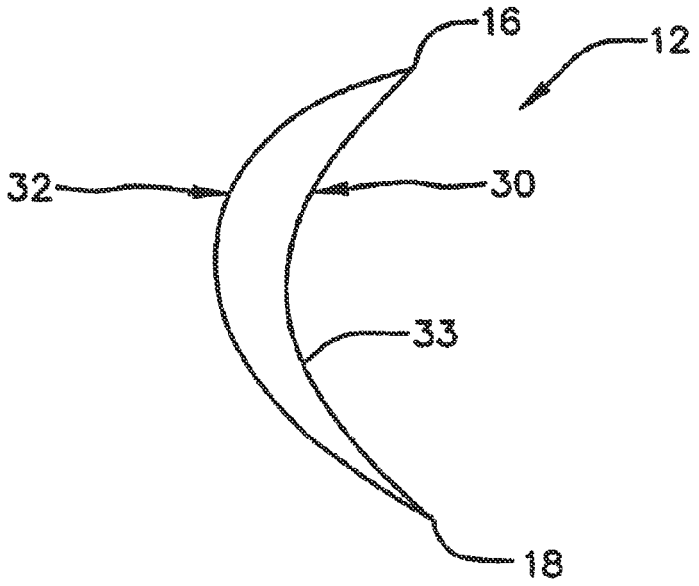
FIG. 2 is a side view of the bra cups shown in FIG. 1.

FIG. 1 is a front view of a backless, strapless bra having a pair of bra cups adjoined by a connector according to an exemplary embodiment of the present invention. Each bra cup 12 has a top 16, a bottom 18 opposite the top, an outer side 20, and an inner side 22 opposite the outer side. Each bra cup also defines an inner top 24, an inner middle 26, and an inner bottom 28. FIG. 2 is a side view of the bra cups shown in FIG. 1. Referring to FIG. 2, each bra cup 12 defines two surfaces relative to the user, an interior surface 30 facing towards the user's breasts, and an exterior surface 32 facing opposite the interior surface and away from the user's breasts. At least a portion of the interior surface 30 includes a pressure sensitive adhesive layer 33 that adjoins the bra cups to the user's skin.

The pressure sensitive adhesive (PSA) layer 33 allows the user to place each of the bra cups at a position on the user's breasts that will create a desired support and appearance of the breasts. The amount and type of PSA comprising the pressure sensitive adhesive layer 33 can vary, as can the portions of the interior surface that have the pressure sensitive adhesive layer. Various factors can contribute to the amount, type, and placement of the pressure sensitive adhesive layer such as the size, shape, and weight of the bra cup and the user's breasts, and the type of covering the bra cups are positioned within and the material from which the covering is made. Generally, in exemplary embodiments, approximately 30% to 100% of the interior surface of the bra cups will comprise the pressure sensitive adhesive layer.

The pressure sensitive adhesive layer 33 may be a re-usable PSA that is integrally joined with or built-into the interior surface 30 of each bra cup. The pressure sensitive adhesive layer can be applied to the interior surface of the bra cups by various methods such as spray coating, hot melting, extrusion application, die application, or other methods known for applying a PSA to a substrate. One suitable PSA is the silicone gel adhesive disclosed in U.S. Pat. No. 6,200,195 to Furuno et al., wherein the silicone gel adhesive layer is integrally formed with the underlying body. It is also contemplated that other PSA could be used, including double-sided tape. A pressure sensitive adhesive layer 33, such as the PSA disclosed in Furuno et al., will not readily shift once it is positioned on the user and can be re-used without losing its adhesive properties. Such a pressure sensitive adhesive layer 33 has an adhesion force to the bra cups 12 that is greater than an adhesion force to the user's skin, such that when the bra cups are removed from the user's breasts, the adhesive remains on the bra cups and not the user's skin. Such a pressure sensitive adhesive layer is further able to withstand tremendous movement and pressure from the user without slipping and can even be subjected to water or sweat without degeneration of the adhesive properties. En fact, if such a pressure sensitive adhesive layer becomes dirty (i.e. collects unwanted particles such as dust, lint, or debris), it can be cleaned with soap and water to remove the unwanted particles and fully restore the adhesive properties.

The bra cups 12 are each adapted to accommodate the connector 14. The connector 14 can have many different structures, but generally comprises a means for drawing the two bra cups together when positioned on the user's breasts. An exemplary connector comprises two or more separate portions, where a first portion attaches to one bra cup and a second portion attaches to the other bra cup. The first and second portions of the connector are designed to engage each other in order to adjoin the two bra cups. Furthermore, the separate portions of the connector 14 can be either permanently or removably attached to the bra cups. It is also possible for the connector 14 to be a single unit that removably attaches to both bra cups. Moreover, as noted above, connectors can be a part of the covering itself, such as a type of fabric or material positioned between the two bra cups that causes the two bra cups to be drawn together or adjoined.

The bra cups 12 are understood to include a wide variety of structures that are suitable for supporting breasts, such as traditional bras and breast forms, which can be padded, non-padded, and made from any suitable material including one or more types of fabrics, plastics, foams, water, silicones, gels, etc. The materials and sizes of the bra cups can vary depending on the particular style of the covering, the expected use of the covering and bra assembly, and the preferences of the user.

Exemplary embodiments of suitable bra assemblies for use with the present covering and bra assembly are disclosed in U.S. Patent Pub. No. 2004-0023594 A1 entitled "Backless, Strapless Bra," U.S. Patent Pub. No. 2003-0224700 A1 entitled "Attachable Breast Form Enhancement System," and U.S. Pat. No. 7,407,429 B2 entitled "Garment with Integral Bra System," all of which are incorporated herein by reference.

Once the user adjoins the bra cups to their skin and creates the desired look and position, the user can create greater breast cleavage by pulling the bra cups closer. Furthermore, if the user wants to push-up the breasts, the user can position the bra cups at a lower and more outward position on the breasts, so that the bra cups are drawn upward and together by the connector, or the connector can be positioned at a lower region relative to the bra cups. The placement of the connector relative to the top 16 and bottom 18 of the bra cups will vary the amount of push-up enhancement.

The combination of various types of coverings and bra assemblies can be achieved a number of different ways. One alternative is to add a covering to the bra assembly that does not require substantially modifying the bra assembly's configuration. In other words, the covering can be added to a bra assembly by adjoining the covering to the outer edge 20 of the bra cups. For example, suitable means for adjoining the covering to the bra cups may include sewing, stitching, bonding, heat sealing, using adhesives, using buttons, using snaps, using clasps, and/or using hook and loop fasteners (i.e., VELCRO®).

Figure 3:
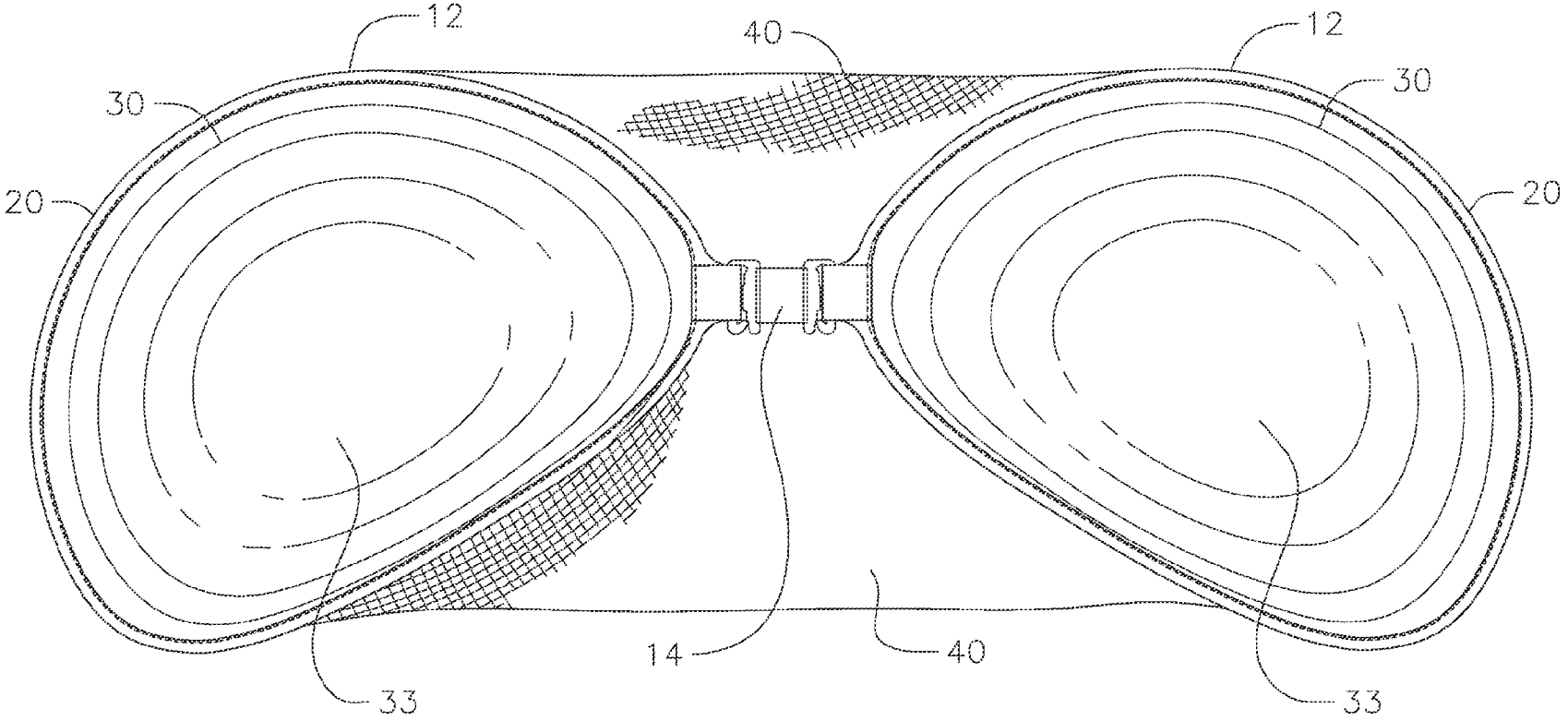
FIG. 3 is a back view of the interior of a bra assembly with a covering attached according to an exemplary embodiment of the present invention.
Figure 4:
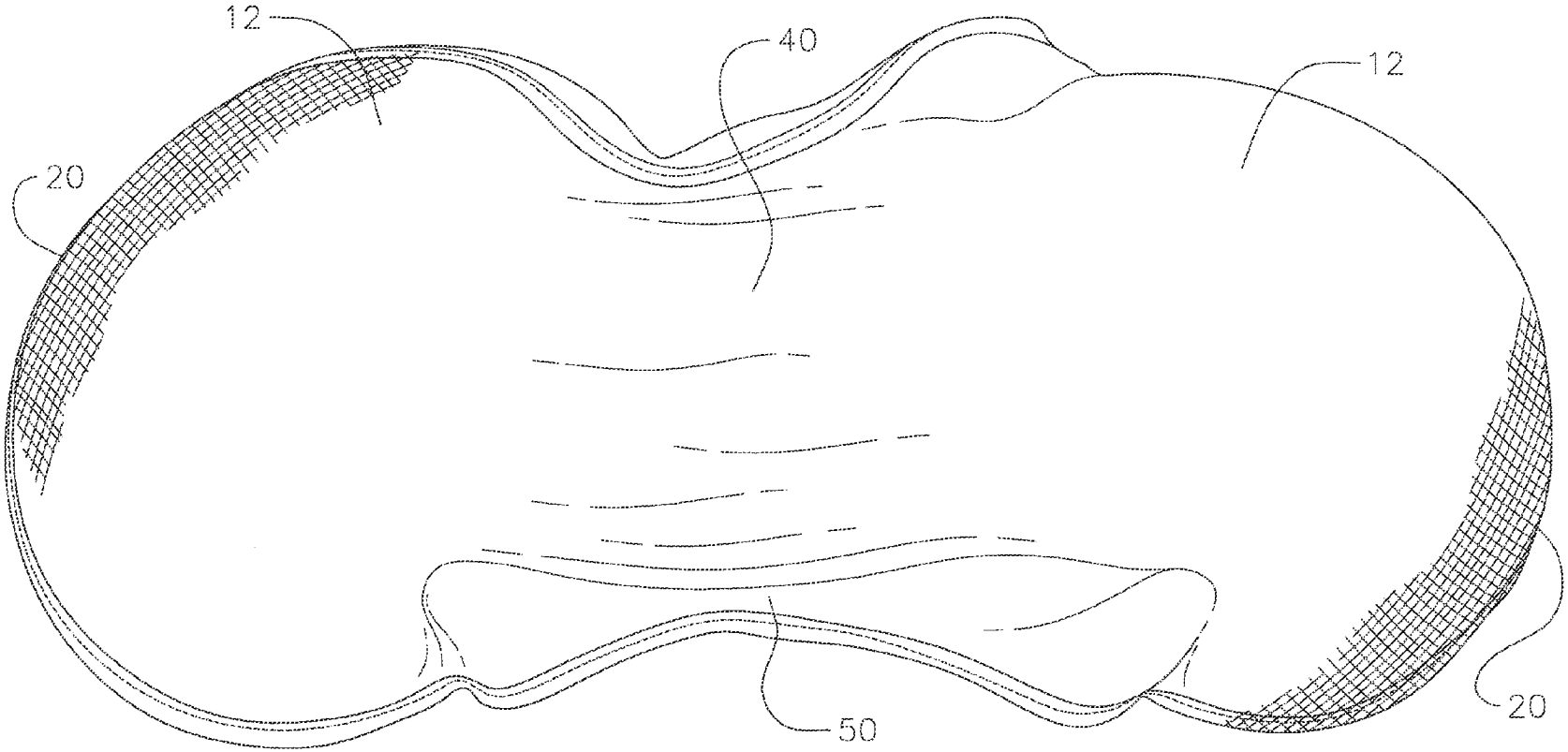
FIG. 4 is a front view of the exterior of the bra assembly shown in FIG. 3.

An exemplary embodiment of the covering that is a part of the bra assembly is shown in FIGS. 3 and 4. FIG. 3 is a view of the interior of a bra assembly with a covering attached according to an exemplary embodiment of the present invention. FIG. 3 shows the interior surface 30 of the bra cups 12 with the covering 40 attached. The bra cups 12 are adjoined via a connector 14. FIG. 3 shows how the covering 40 extends from one bra cup to the other, thereby concealing the bra cups 12 as well as the connector 14. The covering may be coupled to the outer edge of the bra cups 12 in a variety of ways, as discussed above. Furthermore, FIG. 3 shows a pressure sensitive adhesive layer 33 (the circular lines within the bra cups 12) disposed within the interior surface 30 of the bra cups 12.

FIG. 4 is a view of the exterior of the bra assembly shown in FIG. 3. FIG. 4 shows the covering 40 as stitched into the outer edges of the two bra cups 12. The covering 40 extends from one bra cup to the other and contains excess fabric 50 in the area between the two bra cups. This excess fabric 50 allows the covering to be loose in the center portion of the bra assembly. The covering 40 in this embodiment is made of a stretchable material. The combination of the loose covering and the covering being made of stretchable material allows a user broad freedom in adjusting the bra assembly and the covering 40 to the user's preference.

Figure 5:
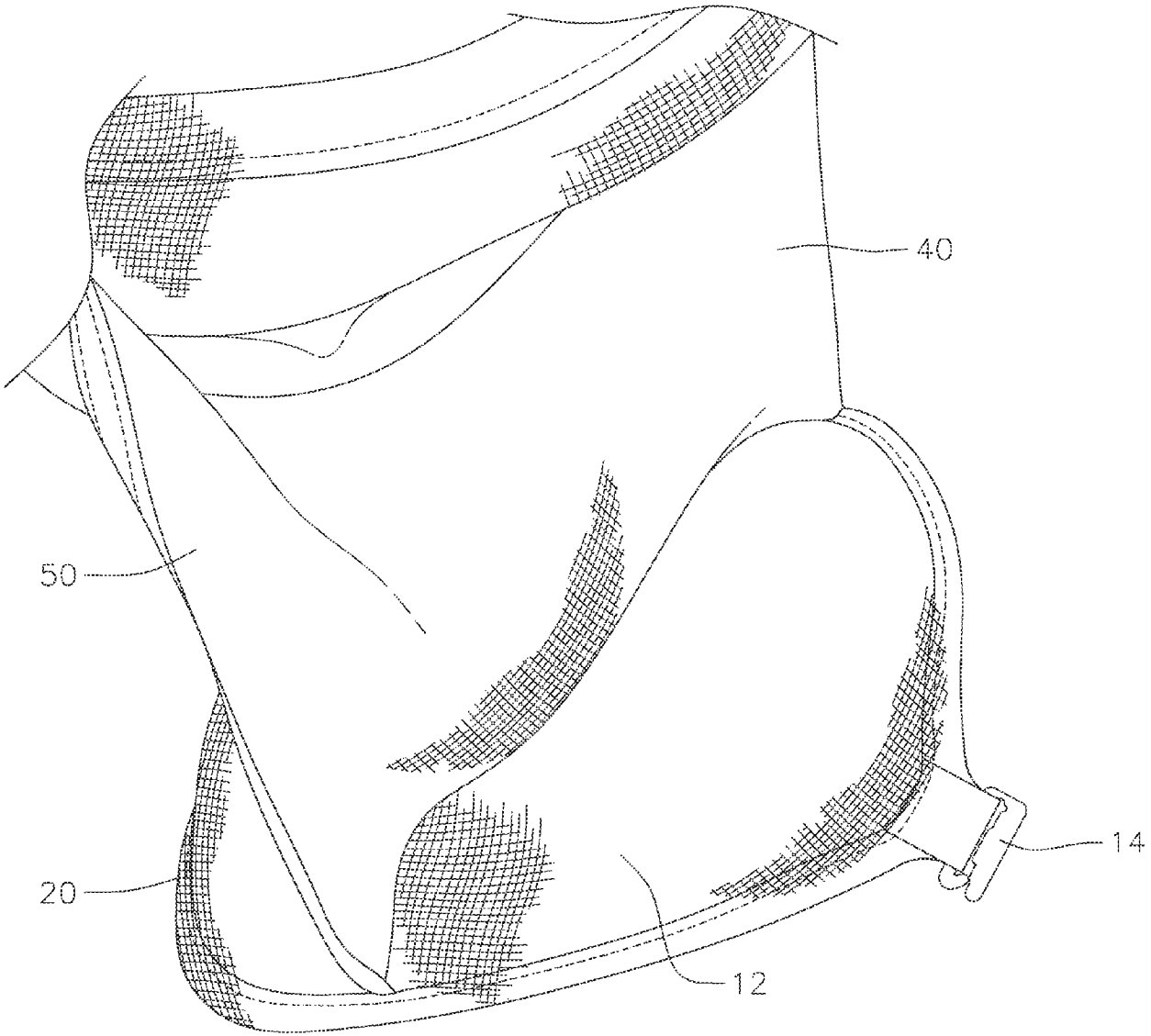
FIG. 5 is a back perspective view of the bra assembly shown in FIG. 3 with the connector detached.

FIG. 5 is a view of the bra assembly shown in FIG. 3 with the connector detached. FIG. 5 shows the covering 40 after the bra cups have been detached from one another. The excess fabric 50 of the covering 40 is shown to be loose and coupled to the outer edge of the bra cups 20 so as to connect the two bra cups 12.

Moreover, as depicted in FIGS. 3 and 4, the covering 40 is configured to conceal the bra assembly and can be adjusted to appear to be a separate shirt or blouse when worn, for example, underneath a low-cut dress. As shown, the covering conceals the connector 14 and bra cups 12 such that the bra assembly does not appear to be a bra at all. This aspect of the embodiment allows a user to wear a sheer garment while not having the user's breasts exposed through the sheer garment while also not requiring the user to wear a traditional bra and having the traditional bra visible through the sheer garment.

Figure 6:
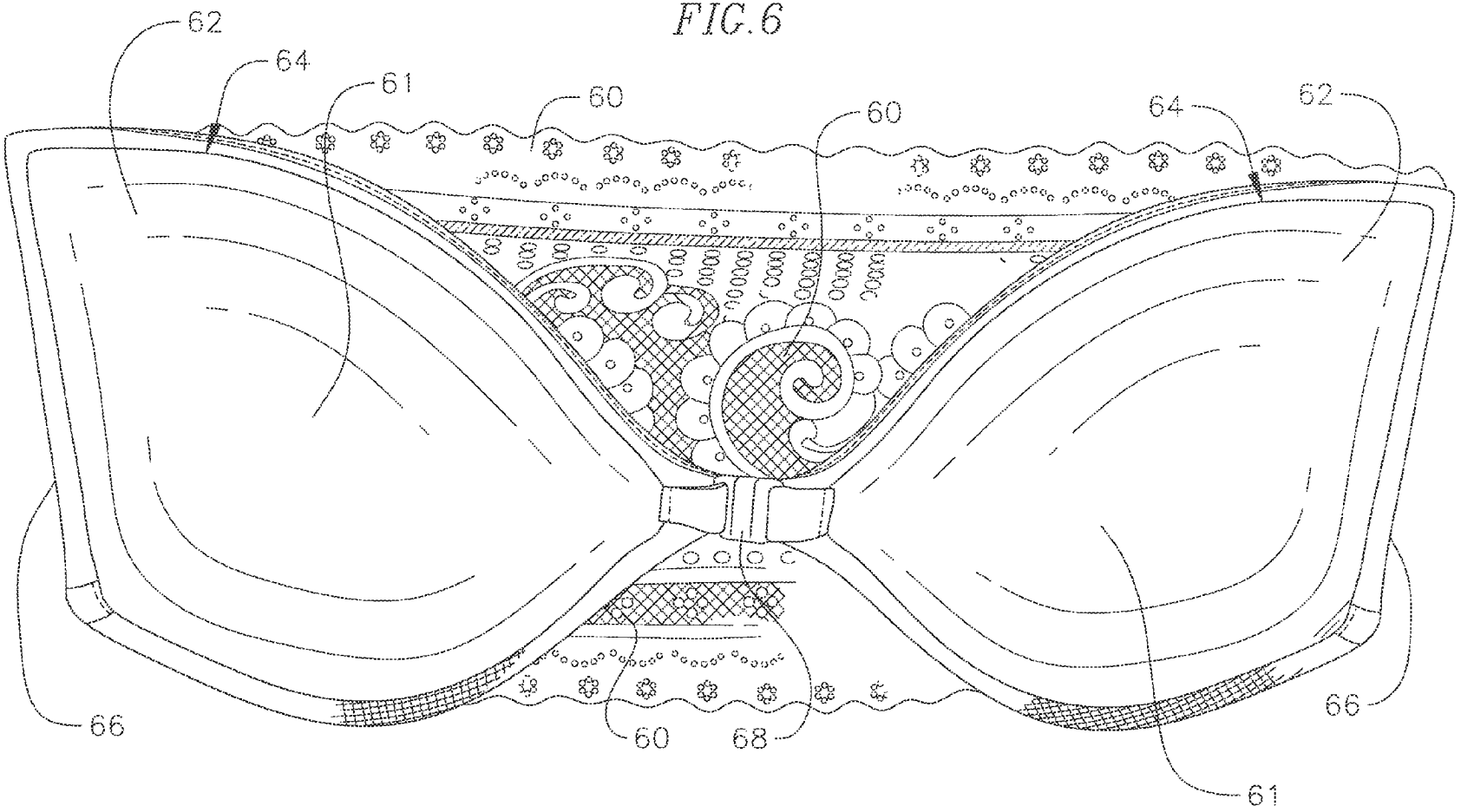
FIG. 6 is a back view of the interior of a bra assembly with a covering attached according to another exemplary embodiment of the present invention.

FIG. 6 is a view of the interior of a bra assembly with a covering attached according to another exemplary embodiment of the present invention. FIG. 6 shows the interior surface 62 of the bra cups 64 with another covering 60 attached over the exterior of the bra cups 64. The differences between this embodiment and the embodiment shown in FIGS. 3-5 are that the covering 60 is a lace covering and the outer edge of the bra cups 66 is linear rather than curved. As shown in FIG. 6, the lace covering 60 is sewn into the outer edge of the bra cups 66. The bra cups 64 are adjoined via a connector 68. FIG. 6 also shows how the lace covering 60 extends from one bra cup to the other, thereby concealing the bra cups 64 as well as the connector 68. FIG. 6 also shows the pressure sensitive adhesive layer 61 (the curved lines on the interior surface 62) disposed within the interior surface 62 of the bra cups 64.

Figure 7:
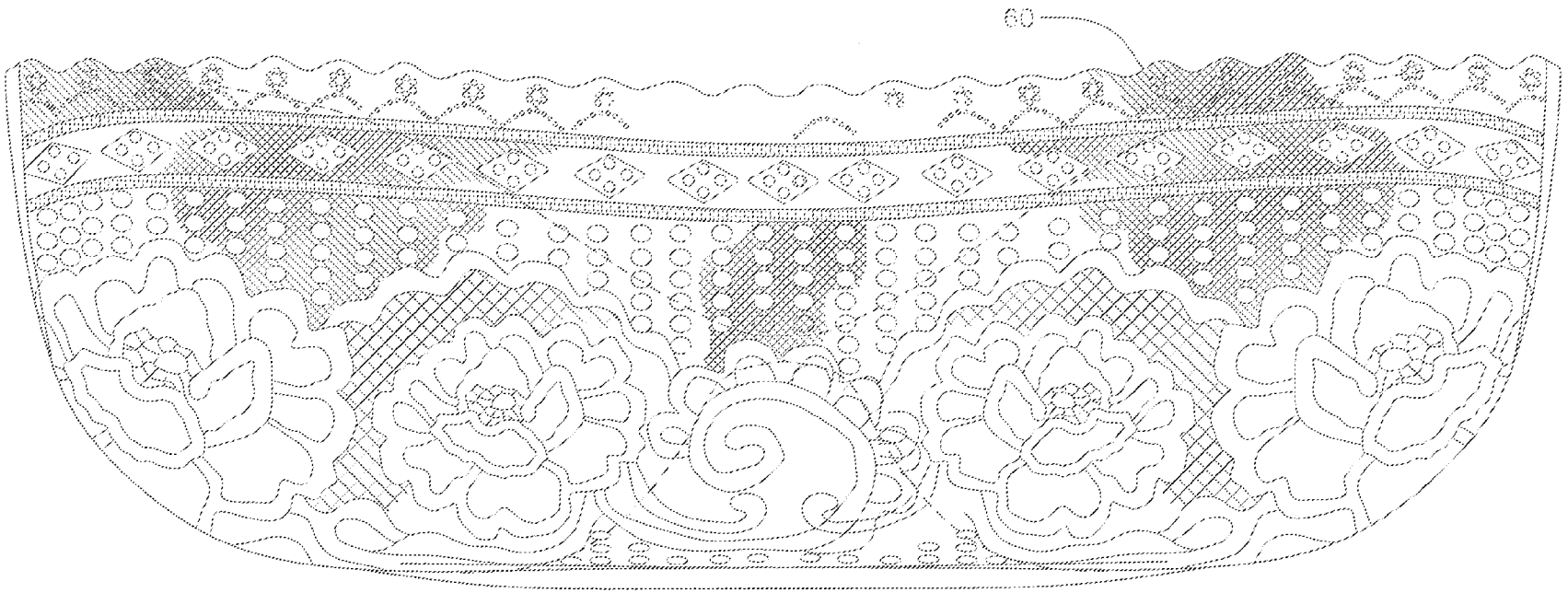
FIG. 7 is a front view of the exterior of the bra assembly shown in FIG. 6.

FIG. 7 is a view of the exterior of the bra assembly shown in FIG. 6. FIG. 7 shows the exterior of the bra assembly with the attached covering. The lace covering 60 extends from one bra cup to the other. The lace covering 60 in this embodiment may be made of a stretchable material.

Figure 8:
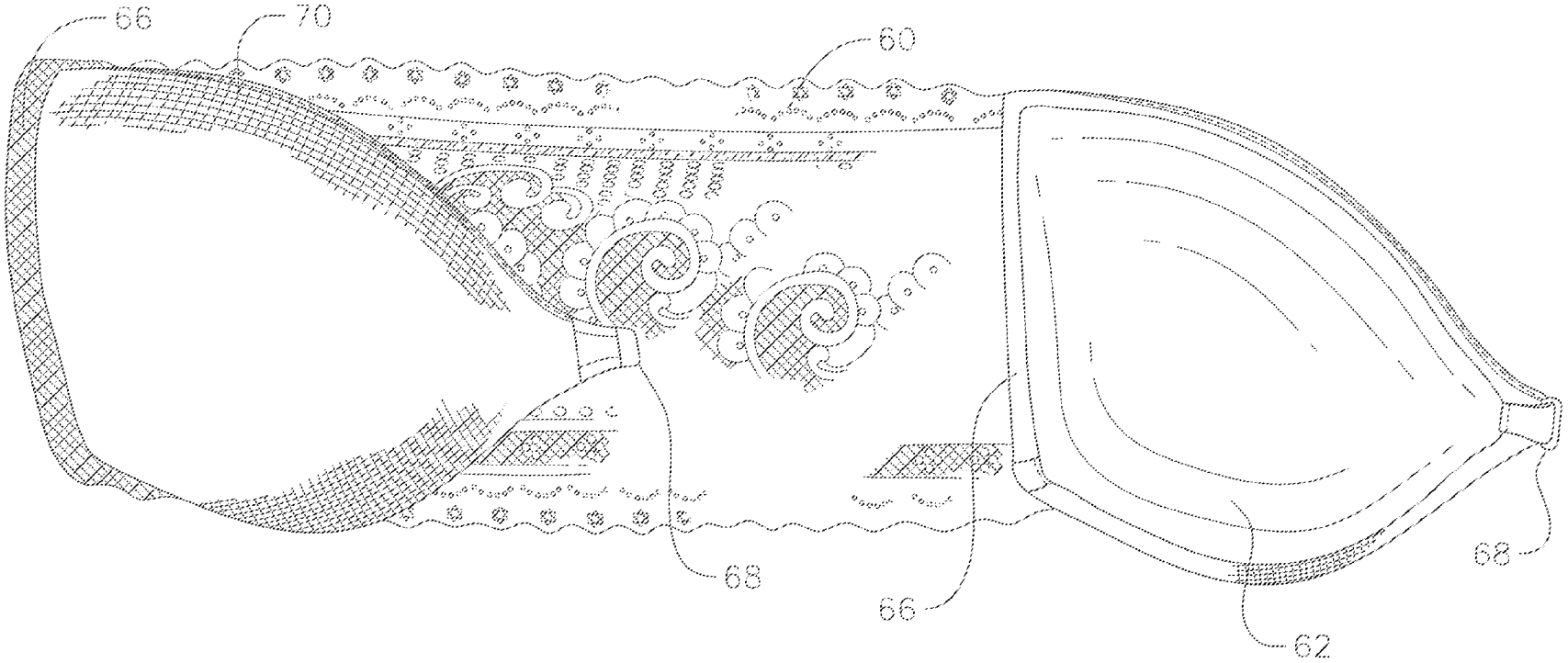
FIG. 8 is a back perspective view of the bra assembly shown in FIG. 6 with the connector detached.

FIG. 8 is a view of the bra assembly shown in FIG. 6 with the connector detached. FIG. 8 shows the bra cups coupled to the lace covering through stitching. As illustrated, only the edges of the lace covering 60 are sewn into the outer edge of the bra cups 66. This feature allows this embodiment to be cost effective during production. FIG. 8 shows the connector 68 as detached with one of the bra cups positioned to show its interior surface 62 and the other bra cup positioned to show its exterior surface 70. FIG. 8 highlights the coupling between the bra cups and the lace covering 60 at the outer edge of the bra cups 66.

Therefore, a user is able to substitute this bra assembly and attached covering for a t-shirt, for example, that would have to otherwise be worn in order to conceal the bra assembly. Accordingly, by the minimal use of fabric to serve as a covering of the bra assembly, a user can wear less and thereby increase overall comfortability and allow the user to keep cool on a hot day.

The present bra assembly with integral covering gives rise to an improved method of using a covering within a bra assembly to replace a traditional bra and to replace an excess article of clothing that would be used to cover the bra, while allowing for adjustable breast cleavage and push-up enhancement. The user can wear the bra assembly and integral covering for its intended purpose, yet have the ability to individually position each of the bra cups in a desired position on the user's breasts and then draw the bra cups together with the connector in order to create the desired shape and appearance of their breasts. An exemplary method of using the bra assembly comprises positioning the bra on the user's body such that the bra cups adjoined to the inside surface of the covering are oriented towards the user's breasts; independently positioning the bra cups over each of the user's breasts, wherein the interior surface of the bra cups are adapted for placement over the user's breasts; adjoining the pressure sensitive adhesive layer disposed along the interior surface of each of the bra cups to a desired position on the user's breasts, wherein the pressure sensitive adhesive layer of each bra cup is sufficiently readily removed from the user's breast independently of the other bra cup to be repositionable relative to the user's breast and to the adjacent bra cup; adjoining the bra cups together by engaging the connector positioned between inner sides of each of the bra cups, wherein the first portion and second portion of the connector are adapted to cooperatively engage, whereby engaging the first portion and the second portion moves the bra cups and the user's breasts together and creates an amount of breast cleavage; adjusting the amount of breast cleavage by removing at least one of the bra cups from the user's breasts and repositioning the bra cups at a different position on the user's breasts, such that the distance between the inner sides of the bra cups before they are adjoined together affects the amount of breast cleavage created when the bra cups are adjoined together.

In addition to the specific features and embodiments described above, it is understood that the present invention includes all equivalents to the structures and features described herein, and is not to be limited to the disclosed embodiments. For example, the size and shape of the bra cups can be varied to any configuration desired by a user of a bra, including various types of partial cup constructions that cover different portions of the user's breasts. The same flexibility for practicing the invention is true with respect to the particular covering that is selected. Additionally, individuals skilled in the art to which the present bra assembly with integral covering pertains will understand that variations and modifications to the embodiments described can be used beneficially without departing from the scope of the invention.

What is claimed is:

1. A backless and strapless bra assembly comprising:

a pair of bra cups, wherein each bra cup comprises an outer lateral edge;

a connector between the bra cups connecting the bra cups together on a user's torso when worn; and a covering coupled to the outer edge of each bra cup and extending from one outer lateral edge of the pair of bra cups to the outer lateral edge of the other one of the pair of bra cups across outside surfaces of the pair of bra cups and the connector therebetween, thereby forming a backless and strapless bra assembly that is void of shoulder straps and side, back or rear wings or panels, wherein the pair of bra cups each comprises an interior surface having a pressure sensitive adhesive layer, and wherein the backless and strapless bra assembly is secured to the user's breasts only by the pressure sensitive adhesive layers.

2. The bra assembly of claim 1, wherein the covering comprises excess fabric so as to be loose in a center portion of the bra assembly.

3. The bra assembly of claim 1, wherein the covering is made from stretchable fabric.

4. The bra assembly of claim 1, wherein the covering is coupled to the outer lateral edge of each bra cup by being sewn along the outer lateral edge of each bra cup.

5. The bra assembly of claim 1, wherein the pressure sensitive adhesive layer comprises about 30% to about 100% of the interior surface.

6. The bra assembly of claim 1, wherein the pressure sensitive adhesive layer is applied to the interior surface by spray coating, hot melting, extrusion application, or die application.

7. The bra assembly of claim 1, wherein the pressure sensitive adhesive layer comprises silicone gel adhesive.

8. The bra assembly of claim 1, wherein the pressure sensitive adhesive layer comprises double-sided tape.

9. The bra assembly of claim 1, wherein the pressure sensitive adhesive layer comprises an adhesion force to the pair of bra cups that is greater than an adhesion force to a user's skin.

10. The bra assembly of claim 1, wherein the connector comprises a first portion attached to one of the pair of bra cups and a second portion attached to the other one of the pair of bra cups.

11. The bra assembly of claim 1, wherein the connector is part of the covering.

12. The bra assembly of claim 1, wherein the covering is a lace covering.

13. A backless and strapless bra assembly comprising:

a pair of bra cups adjacent to each other, wherein each bra cup comprises an outer lateral edge; and a covering coupled to the outer edge of each bra cup and extending from one outer lateral edge of the pair of bra cups to the outer lateral edge of the other one of the pair of bra cups across outside surfaces of the pair of bra cups, thereby forming a backless and strapless bra assembly that is void of shoulder straps and side, back or rear wings or panels, wherein the pair of bra cups each comprises an interior surface having a pressure sensitive adhesive layer and each bra cup is configured so that the interior surface will lie over a respective one of a user's breasts, and wherein the backless and strapless bra assembly is secured to the user's breasts only by the pressure sensitive adhesive layers.

14. The bra assembly of claim 13, wherein the covering comprises excess fabric so as to be loose in a center portion of the bra assembly.

15. The bra assembly of claim 13, wherein the covering is made from stretchable fabric.

16. The bra assembly of claim 13, wherein the covering is coupled to the outer lateral edge of each bra cup by being sewn along the outer lateral edge of each bra cup.

17. The bra assembly of claim 13, wherein the pressure sensitive adhesive layer comprises silicone gel adhesive.

18. The bra assembly of claim 13, wherein the covering is a lace covering.

* * * * *